US005323929A

United States Patent [19]

Marlar

[11] Patent Number: 5,323,929

[45] Date of Patent: Jun. 28, 1994

[54] MEDICINE DISPENSER

[76] Inventor: Warner B. Marlar, 300 E. 17th, Claremore, Okla. 74017

[21] Appl. No.: 987,656

[22] Filed: Dec. 9, 1992

[51] Int. Cl.[5] ..... G07F 11/00

[52] U.S. Cl. ..... 221/3; 221/82; 221/121; 221/194

[58] Field of Search ..... 221/15, 3, 2, 75, 82, 221/86, 89, 76, 69, 121, 194, 155

[56] References Cited

U.S. PATENT DOCUMENTS

| | | | |
|---|---|---|---|
| 1,577,592 | 3/1926 | Robertson et al. . | |
| 1,744,854 | 1/1930 | Zinna | 221/82 |
| 4,207,992 | 6/1980 | Brown | 221/15 |
| 4,572,403 | 2/1986 | Benaroya | 221/3 |
| 4,674,651 | 6/1987 | Scidmore et al. | 221/3 |
| 4,748,600 | 5/1988 | Urquhart | 368/10 |
| 4,809,877 | 3/1989 | Albright | 221/75 |
| 4,911,327 | 3/1990 | Shepherd et al. | 221/3 |
| 5,000,343 | 3/1991 | Allen | 221/82 |
| 5,004,966 | 4/1991 | Eakin | 318/446 |

*Primary Examiner*—Kenneth W. Noland
*Attorney, Agent, or Firm*—Head & Johnson

[57] ABSTRACT

A mutually operated medicine dispenser having a programmable timer and alarm for indicating when a patient is to take medicine. A plurality of prefilled compartments are formed between a rotatable finned carousel and a basket within which the carousel resides. As the carousel rotates, the individual compartments align with a window in the bottom of the basket allowing the medicines within the aligned compartment to fall through the window, through a spout to be dispensed.

12 Claims, 5 Drawing Sheets

Fig. 2
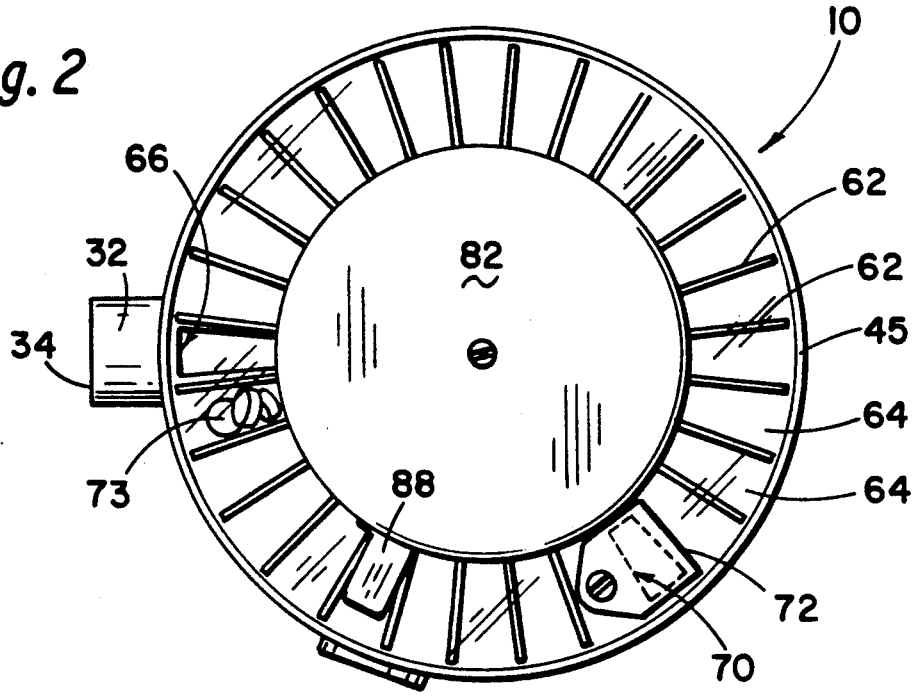
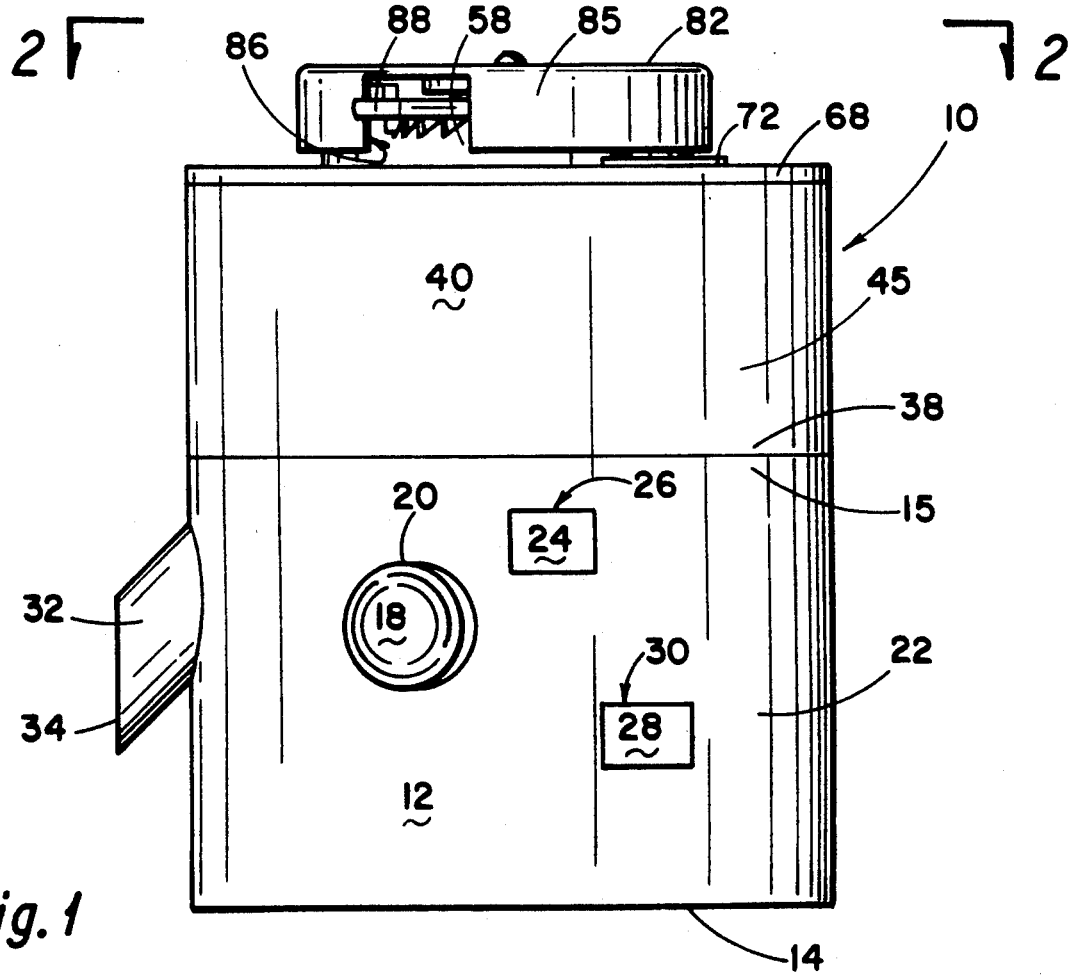
Fig. 1

MEDICINE DISPENSER

BACKGROUND OF THE INVENTION

Field of the Invention

The present invention is a medicine dispensing device provided with a programmable timer for signalling a patient at the correct time for taking their medicine and provided with a carousel having compartments prefillable with medicine which is manually rotatable in one direction in order to dispense the contents of only the next adjacent compartment.

Description of the Related Art

Medicine dispensing devices are not new. As the accompanying information disclosure statement reveals, several patents have been granted for such devices. The devices employ a variety of rotatable carousels having compartments for medicine. Some of these carousels can be rotated to align the individual compartments with a dispensing port for dispensing the medicine.

However, the exiting carousels involve complicated, typically motorized, means for controlling and driving the carousel from position-to-position to automatically align sequential compartments with the dispensing port. These complicated motorized means take both psychological and physical control away from the patient and subject the patient to control by a machine. Also, for those machines that are operated by line current, power failure can inactivate the devices, causing patients to become frustrated or anxious when they are uncertain about whether they will receive their medication at the proper time. Extended power outages can cause patients to miss their medication.

Another problem with existing medicine dispensing devices is that some of them automatically dispense the medicine whether or not the patient responds to the indicating alarm. Thus, medication can be innocently lost by the patient or double dosages can be taken without the patient being aware of the situation. This is possible in light of the fact that many patients for whom medicine dispensing devices are obtained are somewhat forgetful and are dependent upon the device to supply the proper dosages at the proper time. Older patients, in particular, tend not to question the functioning of a sophisticated device which is so complicated that they do not understand how it works.

Another problem with existing devices is that, due to their sophistication, they are expensive to purchase and are often beyond the means of many elderly individuals who, although they badly need the assistance which such devices could render, cannot afford to purchase them.

The present invention is directed to these problems by providing a device for dispensing medicine which is simple to use and is manually operated by the patient. This allows the patient to remain in control rather than to be controlled by a machine. Since the invention is manually operated, power failures have no effect on the device. Also, the present invention has a clear top which allows the patient to see the pills he or she is to take and, if the carousel becomes jammed, the patient can use the filler hole to extract the medication from the compartment. Additionally, the present invention does not dispense medicine automatically, thus reducing the possibility of the patient losing medication or taking double doses. The present invention also allows supervisory personnel to tell if dosages have been missed by checking the number of empty compartments.

SUMMARY OF THE INVENTION

Briefly, the present invention is a device for manually dispensing medicine at times programmable on an internally provided timer having either an audible or visual alarm. The device consists of a stationary basket removably mounted upon a canister so that a window provided in a bottom of the basket aligns with a receiving end of a spout provided in the canister. The spout is downwardly sloped and extends outside the canister, terminating at a dispensing end. The timer and alarm are housed in a storage area within the canister which has space for storing extra medicine, etc. A post mounts to the bottom of the basket and extends vertically upward. A carousel rotatably mounts in the basket on the post by means of a central disk attached to the carousel which engages a shoulder provided on the post. The carousel is provided with a central hub having upwardly projecting teeth and with outwardly projecting fins so that compartments are formed between adjacent fins and the basket. A filler ring covers the top of the compartments and is provided with a filler hole as a means of inserting medicine into the compartment. The filler hole is provided with a movable filler hole cover. A top plate secures to the post above the carousel and is provided with an anti-reverse tab which engages the teeth to limit rotation of the carousel to one direction. A flexible lever rotatably mounts to the post above the top plate and extends outward between stops provided on the top plate, the stops functioning to limit the lever's rotation. The lever and the filler ring are secured in place by means of a cover having a gap to allow an end of the lever to extend beyond the cover. The lever is provided with an ear which is engagable with the teeth in ratchet fashion as a means of turning the carousel to align the next adjacent compartment with the window, and thus dispensing the contents of the compartment.

BRIEF DESCRIPTION OF THE DRAWINGS

FIG. 1 is a side elevation of a medicine dispenser constructed according to a preferred embodiment of the present invention;

FIG. 2 is a top plan elevation of the medicine dispenser taken along line 2—2 of FIG. 1;

DETAILED DESCRIPTION OF THE PREFERRED EMBODIMENTS

Figure 3:
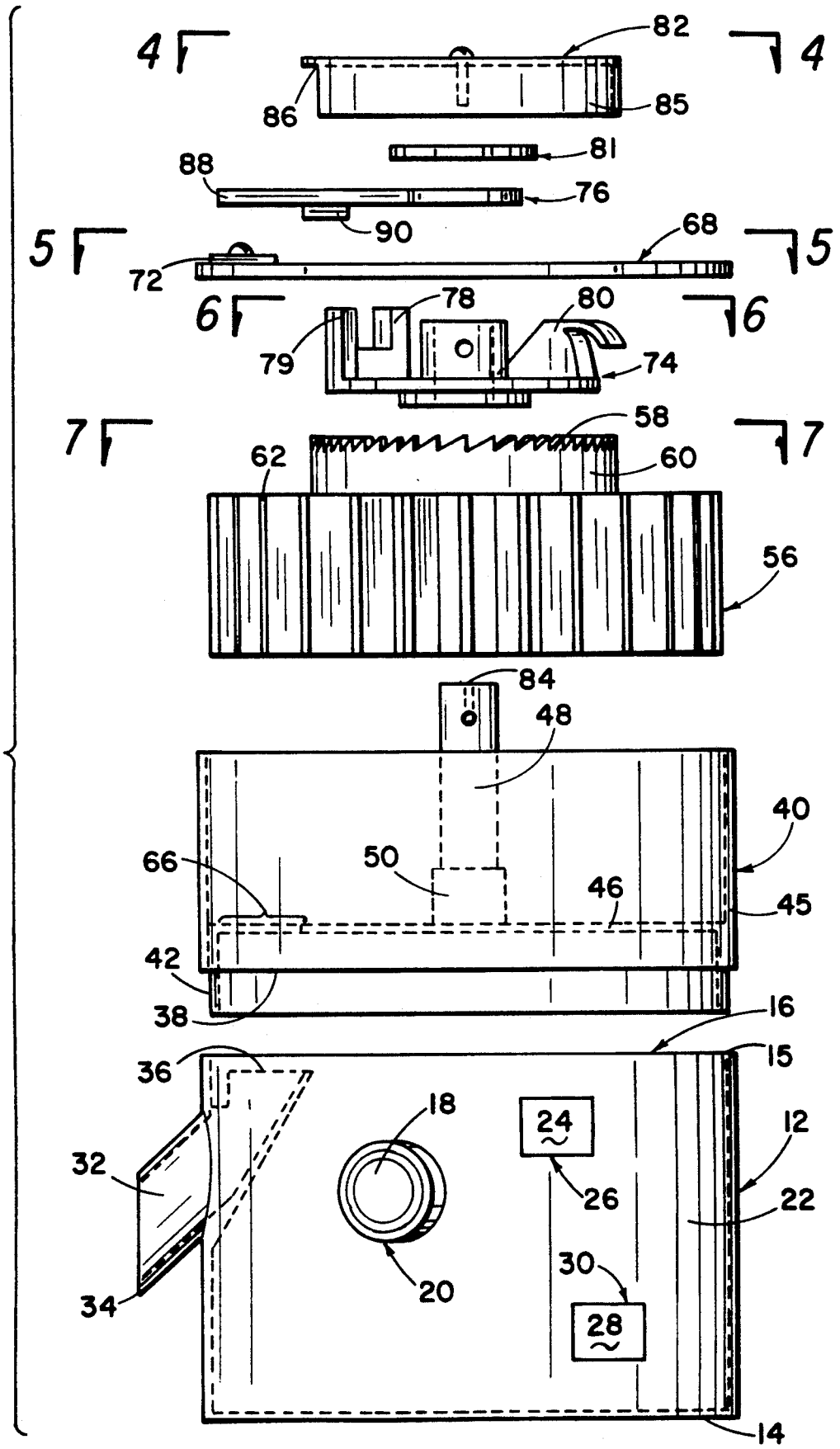
FIG. 3 is an exploded side elevation of the medicine dispenser of FIG. 1.

Referring now to the drawings and initially to FIGS. 1 and 2, there is illustrated a medicine dispenser 10 constructed according to a preferred embodiment of the present invention. The medicine dispenser 10 is provided with a cylindrical canister 12 having a base 14 on which the medicine dispenser 10 rests. As illustrated in FIG. 3, the canister 12 is open around its top edge 15 to reveal a storage area 16 contained within the canister 12 for storing extra medicine (not shown), etc. A digital timer 18 is also located within the storage area 16 and extends through a first opening 20 of the canister 12. The timer 18 has four "on" and four "off" settings (not illustrated) enabling the timer 18 to be set for as many as four different times for administering medication within a twenty-four hour period. The timer 18 is attached to an audible alarm 24 which extends through a second opening 26 in the wall 22. The audible alarm 24 is activated by the timer 18 to signal the patient (not shown) when it is time to take their medication. Optionally, a visual alarm 28 such as a light can be attached to the timer 18 and extended through a third opening 30 in the wall 22 for use by a hearing impaired patient (not shown).

The canister 12 is also provided with a spout 32 which extends through the wall 22. The spout 32 has a dispensing end 34 located outside the canister 12 and a receiving end 36 located within the storage area 16 and is positioned so the receiving end 36 opens upward.

Figure 8:
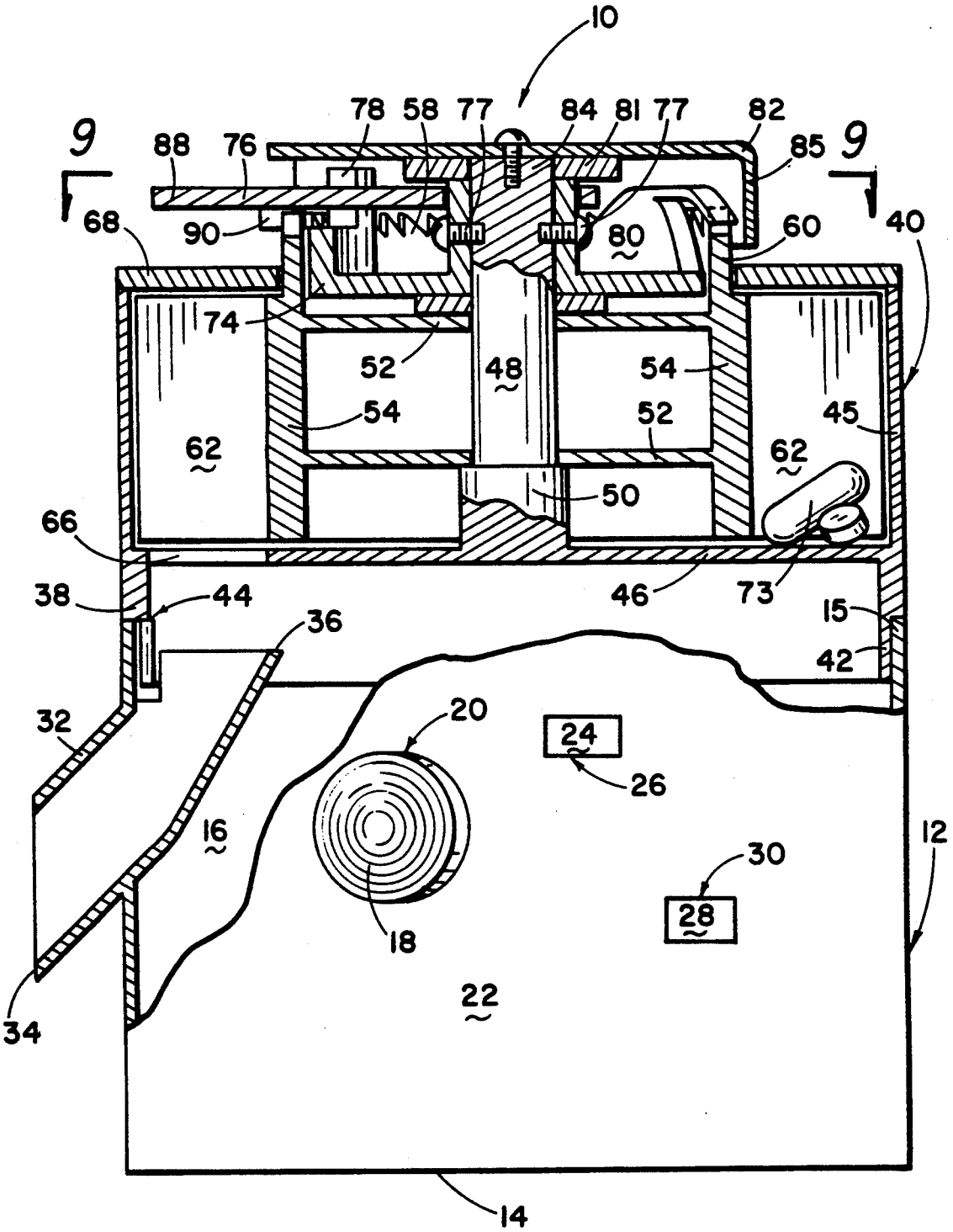
FIG. 8 is an enlarged and partially cut away side elevation of the medicine dispenser of FIG. 1.

A lower edge 38 of a cylindrical basket 40 removably engages the top edge 15 of the canister 12, and the basket 40 is retained on top of the canister 12 by means of a downward oriented lip 42 provided on the lower edge 38 of the basket 40. The lip 42 is slightly smaller than the top edge 15 of the canister 12 so that the lip 42 inserts into the storage area 16, adjacent to the top edge 15 in order to install the basket 40 onto the canister 12. As best seen in FIG. 8, the lip 42 is continuous around the lower edge 38 except for a slot 44 provided in the lip 42 which aligns with the spout 32 so that the spout 32 is held within the slot 44 as the basket 40 is installed on the canister 12. Thus, once the basket 40 is installed on the canister 12, the spout 32 and the slot 44 prevent the basket 40 from turning relative to the canister 12.

Referring now to FIGS. 3 and 8, the basket 40 is hollow internally and is provided with a side upright 45 and a bottom 46. The bottom 46 has a centrally located post 48 extending upward therefrom. The post 48 is provided with a shoulder 50 on which a lower of two central disks 52 rotatably mounts. Each central disk 52 is attached to a central hub 54 of a carousel 56. Teeth 58 are provided on an upper edge 60 of the central hub 54 as a means for turning the carousel 56 as will be explained more fully hereafter.

Figure 7:
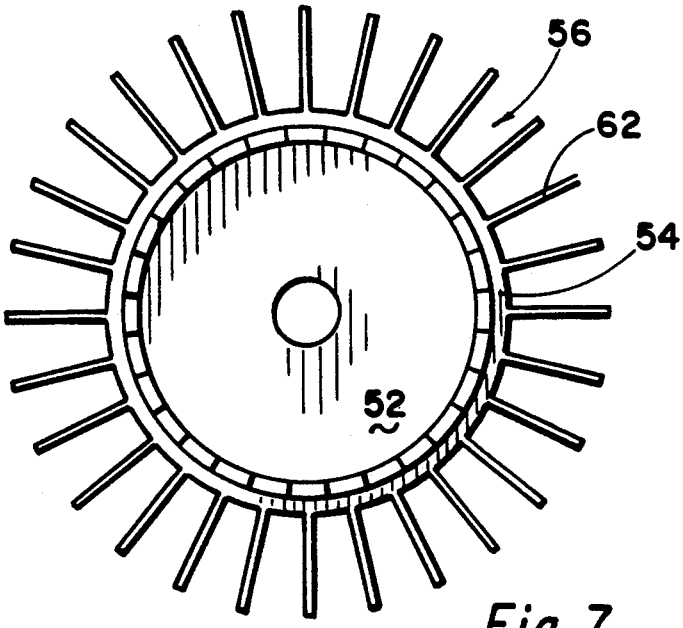
FIG. 7 is a top plan elevation of the carousel taken along line 7—7 of FIG. 3.

As shown in FIGS. 2 and 7, the carousel 56 is a spoke mechanism with vertically oriented fins 62 mounted on the center hub 54 so that the fins 62 extend to the side upright 45 of the basket 40 and define a plurality of separate compartments 64 located within an area defined by adjacent fins 62, the side upright 45 and the basket bottom 46. Preferably, the medicine dispenser 10 is provided with twenty-eight compartments 64, a sufficient number to accommodate a week's supply of medicine when the medicine is to be taken four times per day.

Figure 9:
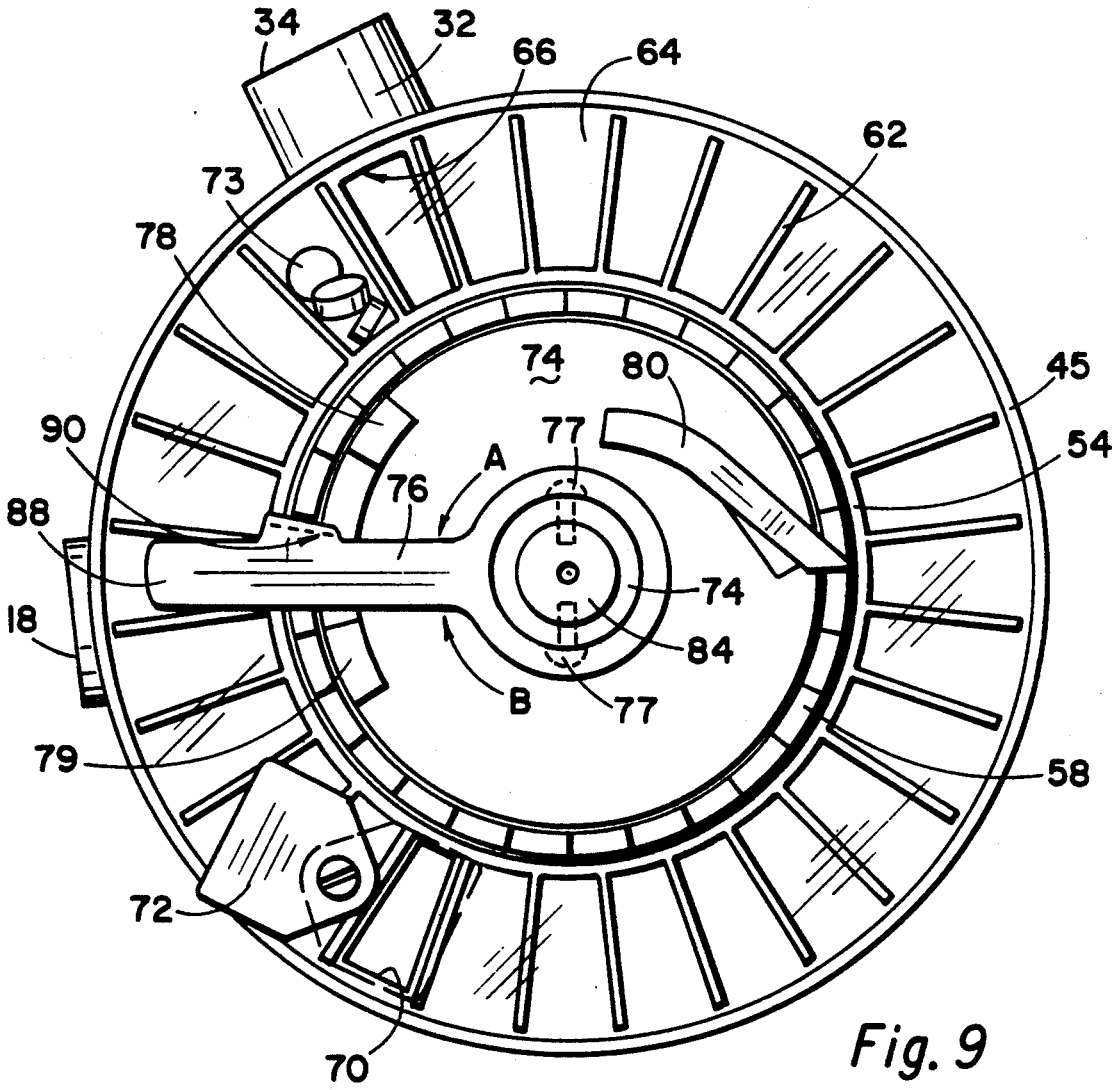
FIG. 9 is a top plan view of the medicine dispenser taken along line 9—9 of FIG. 8 showing the medicine dispenser with the cover and washer removed.

FIGS. 8 and 9 show the basket bottom 46 is provided with a window 66 which is positioned above the receiving end 36 of the spout 32 and is shaped so that, as the carousel 56 is rotated, only one compartment 64 coincides with the window 66 at a time. When a compartment 64 is aligned with the window 66, the window 66 serves as a means of allowing medicine contained within the compartment 64 to fall by gravity through the window 66 into the receiving end 36 of the spout 32, through the spout 32 and out of the medicine dispenser 10 at the dispensing end 34 of the spout 32.

Figure 5:
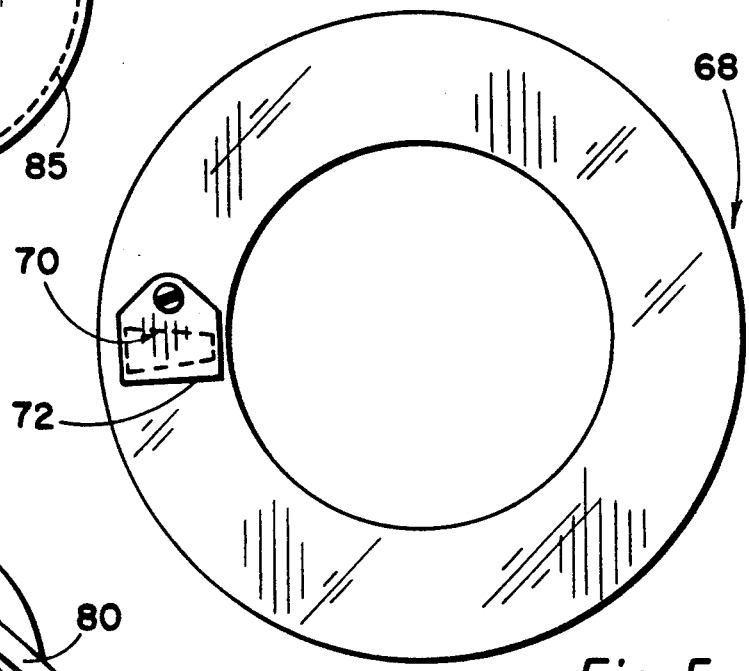
FIG. 5 is a top plan elevation of the filler ring taken along line 5—5 of FIG. 3.

A clear, freely rotatable filler ring 68, illustrated in FIGS. 3 and 5, is provided around the center hub 54 and extends to the side upright 45, forming a cover for the compartments 64. The filler ring 68 is provided with a filler hole 70 accessible by a movable swinging filler hole cover 72 attached to the filler ring 68. The filler hole cover 72 can be swung open and the filler ring 68 rotated in order for supervisory or medical personnel (not shown) to fill the compartments 64 with the appropriate non-liquid medicine, generally pills 73.

Figure 4:
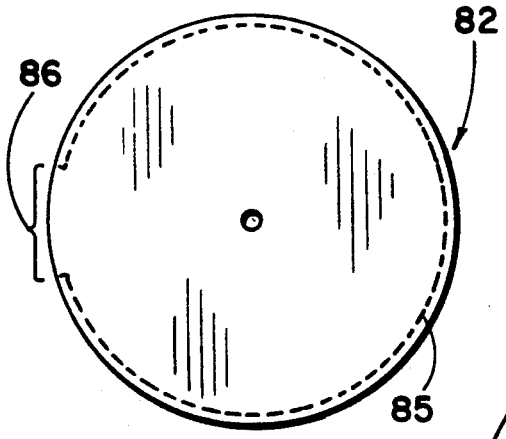
FIG. 4 is a top plan elevation of the cover taken along line 4—4 of FIG. 3.
Figure 6:
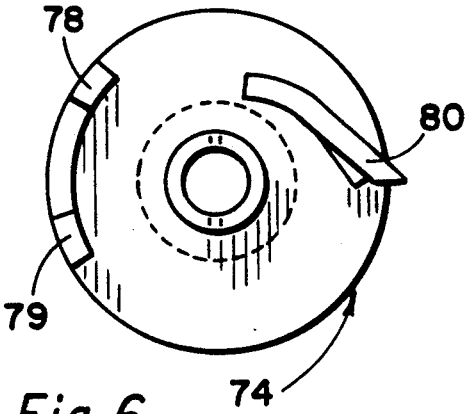
FIG. 6 is a top plan elevation of the top plate taken along line 6—6 of FIG. 3.

As shown in FIGS. 3, 6 and 9, a top plate 74 is secured to the post 48 above the carousel 56 and a flexible lever 76 rotatably attaches by means of screws 77 or other suitable means to the post 48 above the top plate 74. The lever 76 extends outward from the post 48, extending between a forward stop 78 and a rear stop 79 which are provided on the top plate 74 and which limit rotation of the lever 76. The top plate 74 is provided with an anti-reverse tab 80 which engages the teeth 58 to prevent the carousel 56 from rotating in a counterclockwise direction "A". The lever 76 and the filler ring 68 are held in place by a washer 81 and a cover 82 which secures to a free end 84 of the post 48. FIG. 4 shows that the cover 82 has a downward oriented peripheral lip 85 provided with a gap 86 through which an end 88 of the lever 76 extends. The lever 76 is provided with a downward facing ear 90 which is engagable in ratchet fashion with the teeth 58.

As illustrated in FIGS. 4 and 9, in order to turn the carousel 56, the lever 76 is first moved counterclockwise "A", then clockwise "B" in a ratchet fashion. The lever 76 is flexible so that as the lever 76 is first manually moved counterclockwise "A" by means of pressure exerted on the end 88 of the lever 76, the lever 76 flexes sufficiently upward to allow the ear 90 to be pulled over the tooth 58 adjacent to it. Once the ear 90 has cleared the adjacent tooth 58, it flexes back to its original shape to engage the tooth 58 over which it has just been pulled. The rear stop 79 prevents the lever 76 from rotating sufficiently for the ear 90 to be pulled over the next adjacent tooth 58. Next, the lever 76 is moved clockwise "B", causing the ear 90, which is now engaging the tooth 58 over which it has just been pulled, to rotate the teeth 58 and the attached carousel 56. The forward stop 78 stops the lever 76 from rotating so that the next adjacent compartment 64 of the carousel 56 is positioned over the window 66. In use, the compartments 64 are prefilled via the filler hole 70 with the appropriate medicine. Next, the timer 18 is set for the appropriate times for medication to be taken. When the timer 18 activates either an audible or visual alarm, either 24 or 28, the patient manually moves the lever 76 first counterclockwise "A", then clockwise "B" to dispense the proper medicine.

While the invention has been described with a certain degree of particularly, it is manifest that many changes may be made in the details of construction and the arrangement of components without departing from the spirit and scope of this disclosure. It is understood that the invention is not limited to the embodiment set forth herein for the purposes of exemplification, but is to be limited only by the scope of the attached claim or claims, including the full range of equivalency to which each element thereof is entitled.

What is claimed is:

1. A device for dispensing medicine comprising:

a programmable timer with alarm for indicating when the medicine should be taken, a stationary storage basket open at its top, said basket being provided with a dispensing spout, a carousel housing attachable to the top of said basket, said housing having a bottom to effectively close the top of said basket except for a window in said bottom positioned over said dispensing spout, a carousel rotatably mounted in said housing, said carousel being provided with radial fins so that a plurality of compartments are formed between adjacent fins and said carousel housing, a clear top cover for said housing having means to introduce medicine into each compartment, ratchet teeth at the top of said carousel and means to limit the rotation of said carousel to one direction, a ratchet lever means pivotally connected to said ratchet teeth for manually rotating said carousel so the next adjacent compartment is positioned over the dispensing window.

2. A device according to claim 1 wherein the arm is audible.

3. A device according to claim 1 wherein the alarm is visual.

4. A device for dispensing medicine comprising:

a programmable timer with alarm for indicating when the medicine should be taken, a carousel rotably mounted within a stationary basket, said basket being provided with a bottom having a window, said carousel being provided with fins so that a plurality of compartments are formed between adjacent fins and the basket, a post being centrally mounted to the basket bottom and extending vertically upward, said carousel rotatably mounted to said post, a top plate secured tot he post above the carousel, an anti-reverse tab being attached to said top plate, said anti-reverse tab engagable with teeth provided on the carousel as a means of limiting rotation of the carousel to one direction, a flexible lever rotatably mounted to the post about the top plate, said lever located between stops provided on said top plate in order to limit rotation of said lever, said lever provided with an ear engagable with said teeth for manually rotating said carousel, so that the next adjacent compartment is positioned over the window, means for adding the medicine to the compartments.

5. A device according to claim 4 further comprising a rotatable filler ring being provided above the compartments, said filer ring being provided with a filler hole as a means of adding medicine to the compartment.

6. A device according to claim 5 further comprising a movable filler hole cover being provided on the filler ring to cover the filler hole.

7. A device according to claim 4 further comprising a cover attaching to a free end of the post and securing the lever and the filler ring in place.

8. A device for dispensing medicine comprising:

a stationary basket, said basket being provided with a bottom having a window, a post being mounted to the basket bottom and extending vertically upward, a carousel rotatably mounted on the post and located within the basket, said carousel being provided with fins so that a plurality of compartments are formed between adjacent fins and the basket, a canister provided with a spout extending out of the canister, said canister attaching to the basket with the spout aligned under the window in order that medicine falling out of the compartments via the window pass out of the device through the spout, a top plate secured to the post above the carousel, an anti-reverse tab attaching to said top plate and engaging teeth provided on the carousel as a means of limiting rotation of the carousel to one direction, a flexible lever rotatably mounted to the post above the top plate, said lever extending between stops provided on said top plate in order to limit rotation of said lever, an ear provided on said lever engagable with said teeth in order to turn the carousel stepwise by ratchet movement of the lever, a rotatable filler ring being provided above the compartments as a cover for the compartments, said filler ring being provided with a filler hole as a means of adding medicine to the compartments, a movable filler hole cover being provided over the filler hole, a cover attaching to a free end of the post and securing the lever and filler ring in place, a programmable timer with an alarm located in the canister for indicating when the medicine should be taken.

9. A device according to claim 8 wherein the device is provided with twenty-eight compartments.

10. A device according to claim 8 wherein the alarm is audible.

11. A device according to claim 8 wherein the alarm is visual.

12. A device according to claim 8 wherein the alarm is audible and visual.

* * * * *